US006686885B1

(12) United States Patent
Barkdoll et al.

(10) Patent No.: US 6,686,885 B1
(45) Date of Patent: Feb. 3, 2004

(54) PHASED ARRAY ANTENNA FOR SPACE BASED RADAR

(75) Inventors: Ty L. Barkdoll, Columbia, MD (US); John W. Gipprich, Millersville, MD (US); Bradley L. McCarthy, Baltimore, MD (US); Robert Q. Wenerick, Severn, MD (US); Benjamin R. Myers, Columbia, MD (US); Charles R. Robinson, Pasadena, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/214,767

(22) Filed: Aug. 9, 2002

(51) Int. Cl.[7] ..... H01P 1/18
(52) U.S. Cl. ..... 343/700 MS; 342/372
(58) Field of Search ..... 333/164, 262; 343/700 MS, 846, 853; 370/310, 400, 474; 342/371, 374

(56) References Cited

U.S. PATENT DOCUMENTS 6,118,406 A * 9/2000 Josypenko ..... 343/700 MS
6,157,621 A * 12/2000 Brown et al. ..... 370/310
6,281,838 B1 * 8/2001 Hong ..... 342/371

* cited by examiner

*Primary Examiner*—James Clinger
(74) *Attorney, Agent, or Firm*—Birch, Stewart, Kolasch & Birch, LLP

(57) ABSTRACT

A phased array antenna tile which is steered by microelectromechanical system (MEMS) switched time delay units (TDUs) in an array architecture which reduces the number of amplifiers and circulators needed for implementing an active aperture electronically scanned array antenna so as to minimize DC power consumption, cost and mass of the system, making it particularly adaptable for airborne and spaceborne radar applications.

24 Claims, 16 Drawing Sheets

PHASED ARRAY ANTENNA FOR SPACE BASED RADAR

CROSS REFERENCE TO RELATED APPLICATION

This invention is related to the invention shown and described in U.S. Ser. No. 10/157,935 entitled "Microelectromechanical Switch", filed on May 31, 2002 in the names of L. E. Dickens et al. This application is assigned to the assignee of the subject application and is incorporated herein by reference in its entirety.

BACKGROUND OF THE INVENTION

1. Field of the Invention

This invention relates generally to phased array antennas and more particularly to the architecture of a phased array antenna comprised of one or more antenna tiles consisting of a plurality of laminated circuit boards including various configurations of printed circuit wiring and components.

2. Description of Related Art

Phased array antennas for radar applications are generally known. More recently, the architecture of a radar antenna, particularly for space based radar applications, has resulted in the design of basic building blocks in the form of "tiles" wherein each tile is formed of a multi-layer printed circuit board structure including antenna elements and its associated RF circuitry encompassed in a laminated assembly, and wherein each antenna tile can operate by itself, as a phased array or as a sub-array of a much larger array antenna.

Each tile is a highly integrated module that serves as the radiator, the transmit/receive (TR) module, RF and power manifolds and the control circuitry therefor, all of which are combined into a low cost light-weight assembly for implementing an active aperture, electronically, scanned, array (AESA). Such an architecture is particularly adapted for airborne or space applications.

SUMMARY

Accordingly, it is an object of the present invention to provide an improvement in phased array antenna systems. It is a further object of the invention to provide an improvement in antenna tile architecture.

It is still a further object of the invention to provide an improved architecture of an antenna tile which is particularly adapted for space based radar applications.

The foregoing and other objects are achieved by a phased array antenna tile which is steered by microelectromechanical system (MEMS) switched time delay units (TDUs) in an array architecture which reduces the number of amplifiers and circulators needed for implementing an active aperture electronically scanned array antenna so as to minimize DC power consumption, cost and mass of the system which makes it particularly adaptable for airborne and spaceborne radar applications.

In one aspect of the invention, it is directed to a phased array antenna of an active aperture electronically scanned antenna system, comprising: one or more antenna tile structures, each tile of which further comprises a laminated assembly including a plurality of contiguous layers of dielectric material having patterns of metallization formed on one or more surfaces thereof and selectively interconnected by an arrangement of surface conductors and conductive vias for implementing transmission, reception, and control of RF signals between an RF input/output terminal and of an antenna assembly including a plurality of radiator elements wherein said radiator elements comprise elements of a space-fed patch antenna assembly including first and second mutually adjacent arrays of aligned patch radiators located on respective layers of foam material on one side of the antenna tile structure; and, a plurality of MEMS type switched time delay units (TDUS) mounted on the other side of the antenna tile structure, being packaged in groups of four in a Quad TDU package and being coupled between the antenna elements and a signal circulator comprising one circuit element of a transmit/receive (TR) circuit including a transmit signal amplifier and a receive signal low noise amplifier, each of said MEMS type switched time delay units respectively including a set of four identical delay transmission line assemblies having a plurality of different length time delay segments selectively interconnected by a plurality of microelectromechanical switch (MEMS) devices for steering one radiator element.

Further scope of applicability of the present invention will become apparent from the detailed description provided hereinafter. It should be understood, however, that the detailed description and specific example, while disclosing the preferred embodiment of the invention, it is provided by way of illustration only, since various changes and modifications within the spirit and scope of the invention will become apparent to those skilled in the art.

BRIEF DESCRIPTION OF THE DRAWINGS

The present invention will become more fully understood when the detailed description provided hereinafter is considered in conjunction with the accompanying drawings which are provided by way of illustration only, and wherein.

DETAILED DESCRIPTION OF THE INVENTION

There are several challenges facing the next generation of spaced-based radar, namely: reducing mass, cost and power required by the transmit receive antenna module (TRM) and one comprised of "tiles", particularly where the larger system antenna is made up of an array of tiles. The size, and thus the antenna directivity can be varied simply by changing the number of tiles used.

In a conventional active aperture electronically scanned array (AESA) there exists a separate radiator assembly including a phased array of many radiator elements. Individual TR modules feed each radiator. Behind the array of radiator elements are located several manifolds for RF, power and control distribution. In a tile-type configuration, on the other hand, all of these functions are integrated into a composite structure so as to lower its mass and thus the mass of the overall radar system. Where such a system is used for space-based radar, DC power is at a premium, particularly in a satellite system, for example, since it must be generated by on-board solar cells and stored in relatively massive batteries. Increasing the antenna gain or area quickly reduces the transmitted power required and thus the cost and the mass of the radar system becomes critical.

Accordingly, the present invention is directed to a radar system where the mass is minimized by incorporating the functions of several system blocks into a tile assembly.

Considering now what is at present considered to be the preferred embodiment of the invention, reference will now be made to the various drawing figures which are intended to illustrate the details of one antenna tile which may be used as a single phased array element or one element of a multi-element two dimensional phased array.

Figure 1:
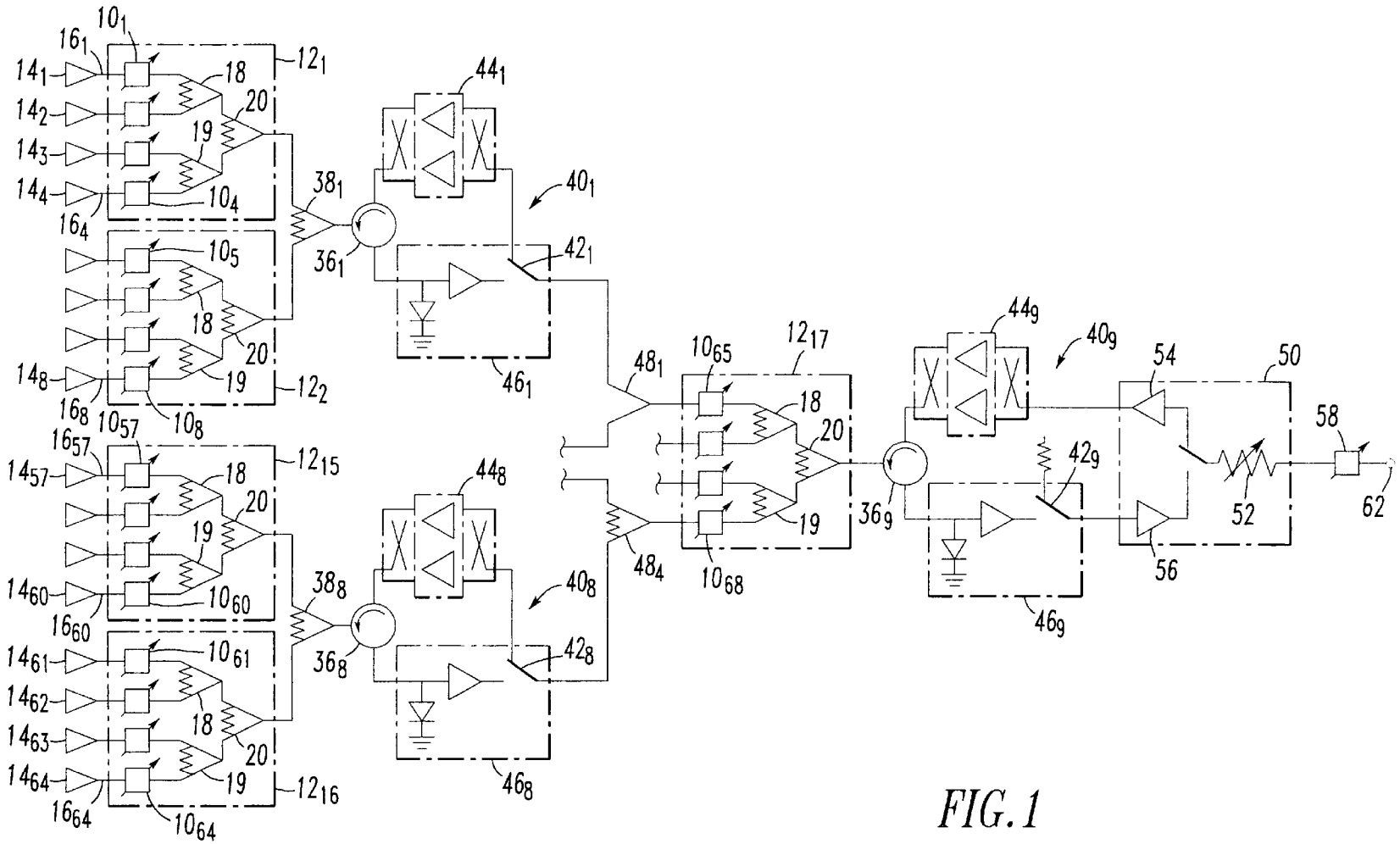
FIG. 1 is an electrical block diagram illustrative of the preferred embodiment of an antenna tile in accordance with the subject invention.

Referring now to FIG. 1, shown there at is an electrical block diagram of the RF portion of a phased array antenna tile in accordance with the preferred embodiment of the subject invention including, among other things, a plurality of circuit elements consisting of identical MEMS switched time delay units (TDU) 10, packaged in groups of four TDUs to form a Quad TDU 12 for steering a respective radiator element 14 of a sixty four element array. As shown, sixty four TDUs $\mathbf{10}_1$, $\mathbf{10}_2$ . . . $\mathbf{10}_{64}$ packaged in sixteen Quad TDUs $\mathbf{12}_1$, $\mathbf{12}_2$ . . . $\mathbf{12}_{15}$, $\mathbf{12}_{16}$, are used to feed sixty-four radiators $\mathbf{14}_1$, $\mathbf{14}_2$ . . . $\mathbf{14}_{64}$ via respective tuned transmission lines $\mathbf{16}_1$, $\mathbf{16}_2$ . . . $\mathbf{16}_{64}$. Further as shown in FIG. 1, in addition to four TDUs 10, each Quad TDU package 12 includes three signal splitters 18, 19 and 20 which are interconnected between the four TDUs, for example TDU $\mathbf{10}_1$ . . . $\mathbf{10}_4$ in quad TDU $\mathbf{12}_1$.

Figure 2:
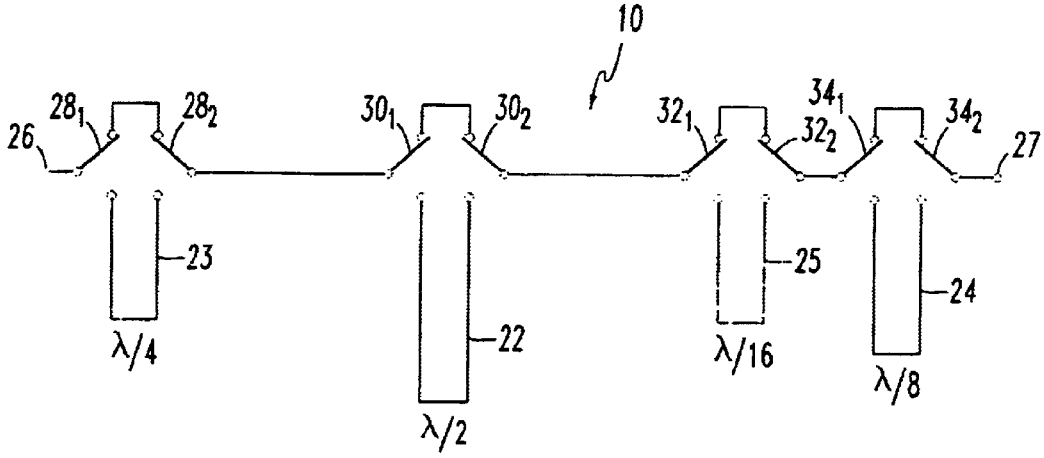
FIG. 2 is an electrical schematic diagram illustrative of one time delay section of a quad time delay unit (TDU) shown in FIG. 1.
Figure 3:
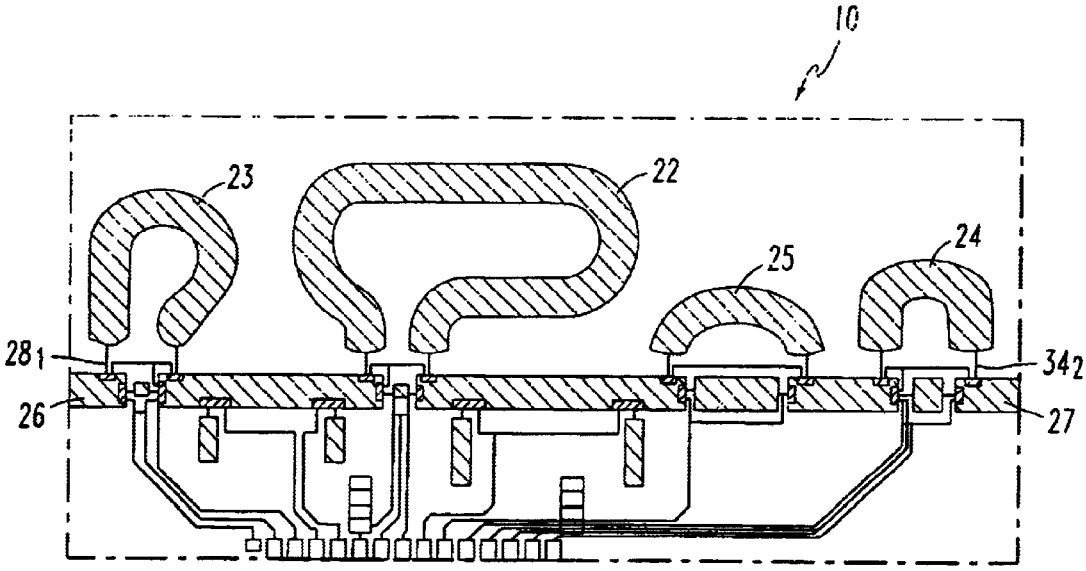
FIG. 3 is a plan view of an implementation of the time delay section shown in FIG. 2.

Each TDU 10 of the sixty four TDUs $\mathbf{10}_1$ . . . $\mathbf{10}_{64}$ are identical and are shown in FIGS. 2 and 3 consisting of four time delay bits λ/2, λ/4, λ/8 and λ/16 respectively implemented with different lengths of microstrip circuit segments 22, 23, 24, and 25. These segments are adapted to be selectively connected between terminals 26 and 27 by pairs of identical MEMS switch devices $\mathbf{28}_1$, $\mathbf{28}_2$, $\mathbf{30}_1$, $\mathbf{30}_2$, and $\mathbf{32}_1$, $\mathbf{32}_2$ and $\mathbf{34}_1$, $\mathbf{34}_2$, preferably of the type shown and described in the above noted related application Ser. No. 10/157,935 entitled "Microelectromechanical Switch", L. E. Dickens et al.

Referring back to FIG. 1, pairs of Quad TDU units $\mathbf{12}_1$, $\mathbf{12}_2$ . . . $\mathbf{12}_{15}$, $\mathbf{12}_{16}$ are respectively coupled to eight intermediate RF signal circulators $\mathbf{36}_1$ . . . $\mathbf{36}_8$ via signal splitters $\mathbf{38}_1$ . . . $\mathbf{38}_8$ which form part of eight respective transmit receive (TR) circuits $\mathbf{40}_1$ . . . $\mathbf{40}_8$, each including respective TR switches $\mathbf{42}_1$ . . . $\mathbf{4}_{28}$ coupled to power amplifiers $\mathbf{44}_1$ . . . $\mathbf{44}_8$ for RF signal transmission and low noise amplifiers (LNA) $\mathbf{46}_1$ . . . $\mathbf{46}_8$ for reception.

Further, the TR circuits $\mathbf{40}_1$ . . . $\mathbf{40}_8$ are coupled to an intermediate signal circulator $\mathbf{36}_9$ of a TR circuit $\mathbf{40}_9$ which is common to all of the radiators $\mathbf{14}_1$ . . . $\mathbf{14}_{64}$ via a MEMS Quad TDU $\mathbf{12}_{17}$ and four power splitters $\mathbf{48}_1$ . . . $\mathbf{48}_4$. The Quad TDU $\mathbf{12}_{17}$ is identical in construction to the aforementioned Quad TDUs $\mathbf{12}_1$ . . . $\mathbf{16}_{16}$ and includes four TDUs $\mathbf{10}_{65}$ . . . $\mathbf{10}_{68}$ and three signal splitters 18, 19 and 20.

The TR circuit $\mathbf{40}_9$ is identical to the TR circuits $\mathbf{40}_1$ . . . $\mathbf{40}_8$ and is shown including a transmit power amplifier $\mathbf{44}_9$ and a switched receive low noise amplifier (LNA) $\mathbf{46}_9$. The amplifiers $\mathbf{44}_9$ and $\mathbf{46}_9$ are shown coupled to a transmit receive amplifier-attenuator circuit 50 comprised of a variable attenuator 52 switched between a transmit power amplifier 54, and a low noise receive amplifier 56. The attenuator 52 is coupled to a "long" time delay unit (LTDU) 58 which connects to RF signal input/output connector 60. LTDU 58 provides a common steering phase for the sixty four individual radiators $\mathbf{14}_1$ . . . $\mathbf{14}_{64}$ which are further modified by their respective TDUs $\mathbf{10}_1$ . . . $\mathbf{10}_{64}$.

The Quad TDUs $\mathbf{12}_1$ . . . $\mathbf{12}_{16}$ significantly reduce the number of amplifiers required in comparison to a conventional active aperture electronically scanned array (AESA) architecture, thus minimizing DC power consumption, cost and mass of the system.

Figure 4:
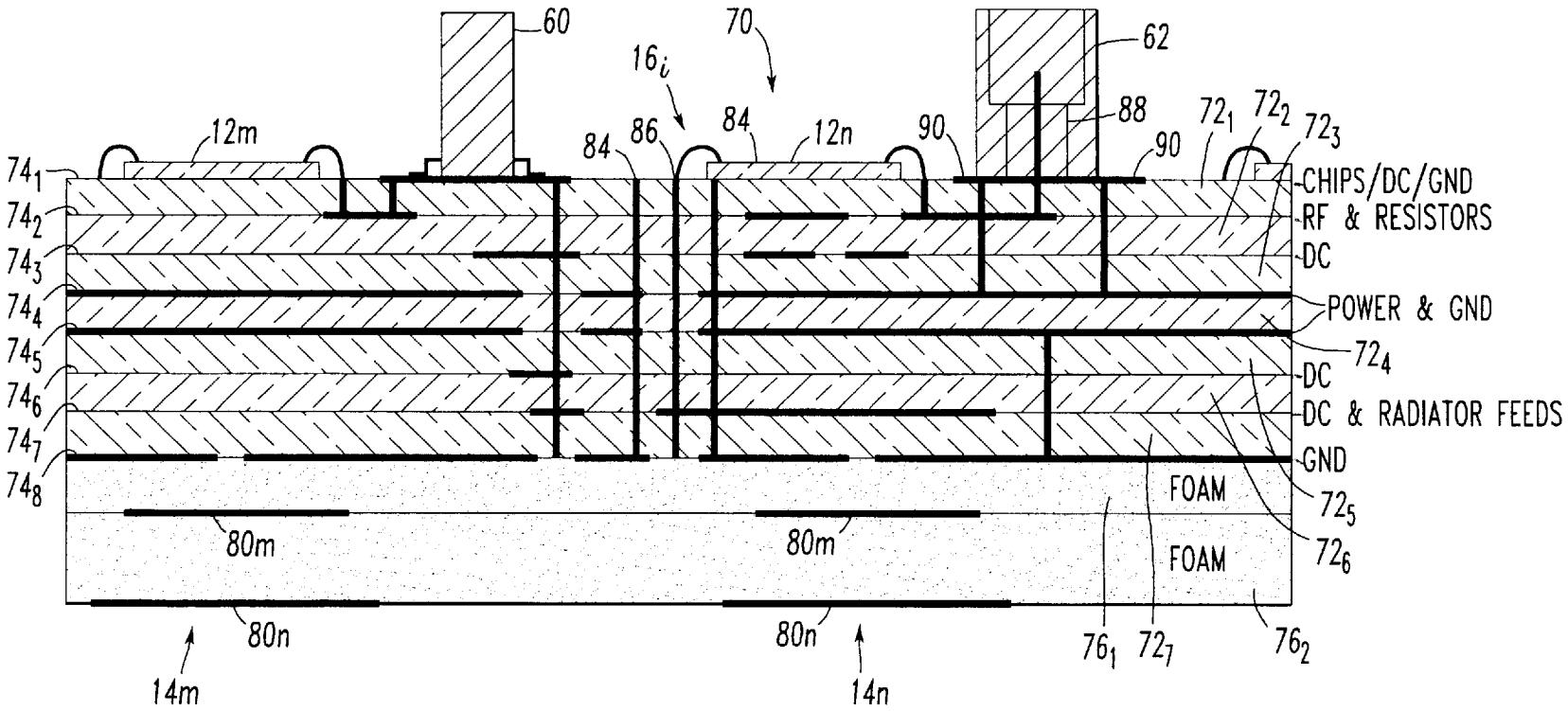
FIG. 4 is a partial vertical cross sectional view of an antenna tile in accordance with the preferred embodiment of the subject invention.
Figure 14:
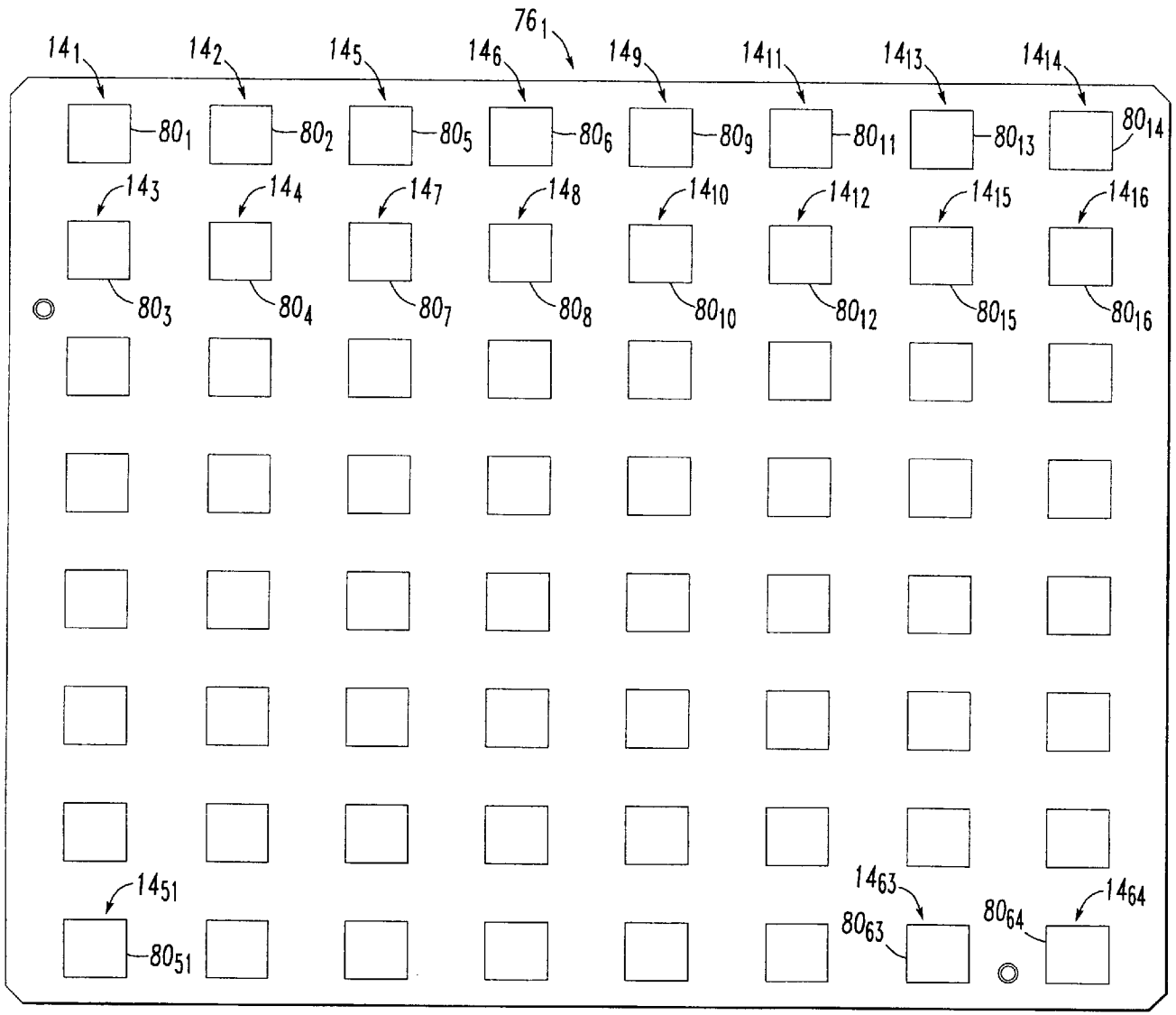
FIG. 14 is a top plan view illustrative of the patch antenna elements located on a ninth surface of antenna tile shown in FIG. 4.
Figure 15:
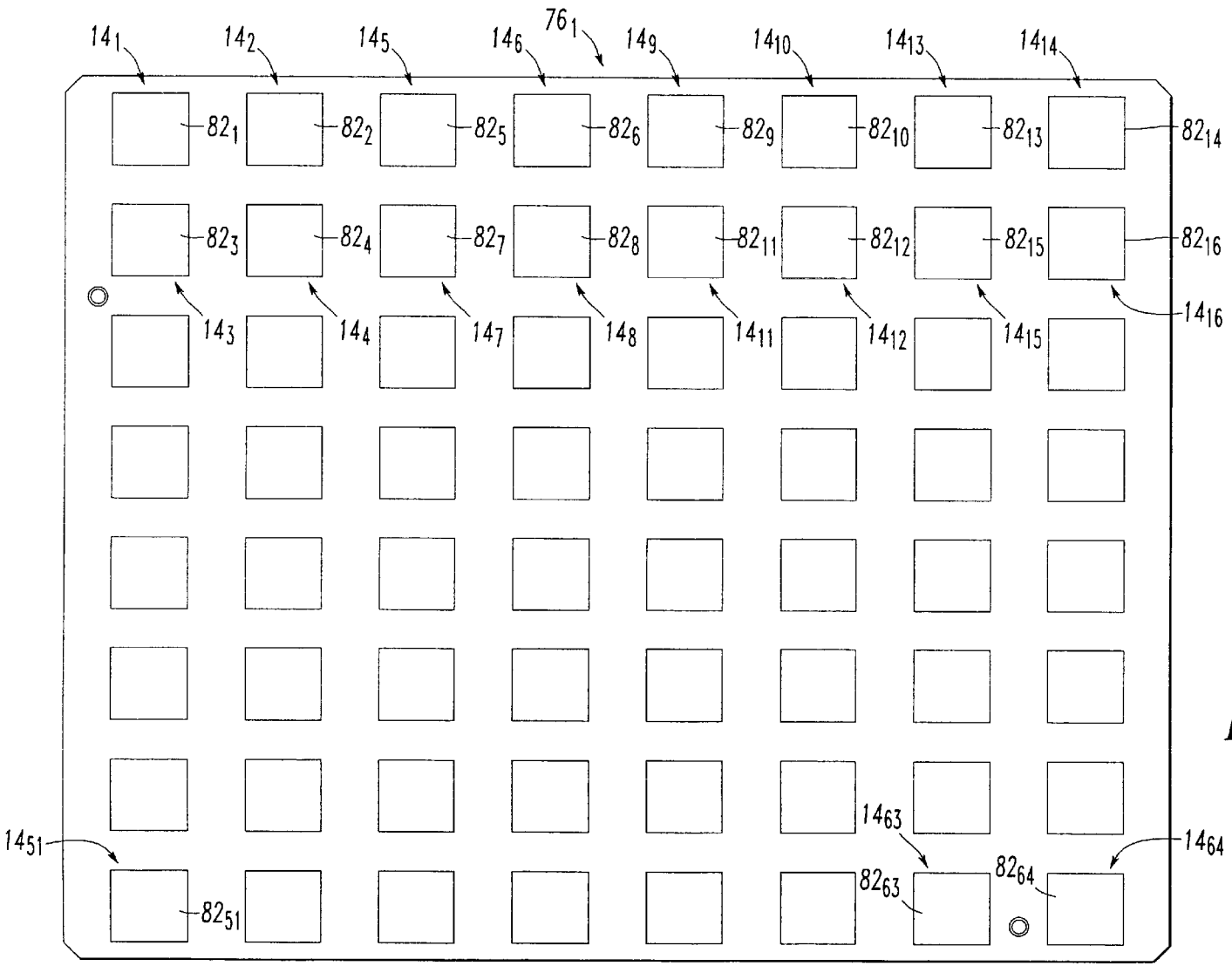
FIG. 15 is a top plan view of the patch antenna elements located on a tenth surface of the antenna tile shown in FIG. 4.

The circuitry shown in FIG. 1 is implemented by a stacked laminate tile structure 70 as shown in FIG. 4 including seven contiguous layers of dielectric material $\mathbf{72}_1$, $\mathbf{72}_2$ . . . $\mathbf{72}_7$ and two layers of foam material $\mathbf{76}_1$ and 762. The dielectric layers $\mathbf{72}_1$, . . . $\mathbf{72}_7$ include eight surface patterns of metallization $\mathbf{74}_1$, $\mathbf{74}_2$, . . . $\mathbf{74}_8$. The foam layers $\mathbf{76}_1$ and $\mathbf{76}_2$ include two mutually aligned sets of sixty four rectangular patch radiators $\mathbf{80}_1$ . . . $\mathbf{80}_{64}$ and $\mathbf{82}_1$ . . . $\mathbf{82}_{64}$ as shown in FIGS. 14 and 15. The details of the metallization patterns are shown in FIGS. 5 through 13.

FIG. 4 discloses the location of a power connector 60 for the application of a DC supply voltage for the active circuit components as well as the RF input/output connector 62 (FIG. 1). The cross section shown in FIG. 4 also depicts two quad TDU packages 12*m* and 12*n* mounted on the upper surface $\mathbf{74}_1$ thereof. FIG. 4 also depicts a pair of metallized vias, 84, 86, which, as will be shown hereinafter, act as outer and inner conductors of, for example, a coaxial RF transmission line $\mathbf{16}_i$ for coupling RF energy to and from one of the radiators, two of which are shown by reference numerals 14*m* and 14*n*, each comprised of respective space fed patch radiators 80*m*, 82*n* and 81*n*, 82*n*. A second pair of coaxial type conductor vias 88 and 90 are used to couple the RF connector 62 to LTDU 58 (FIG. 1).

Figure 5:
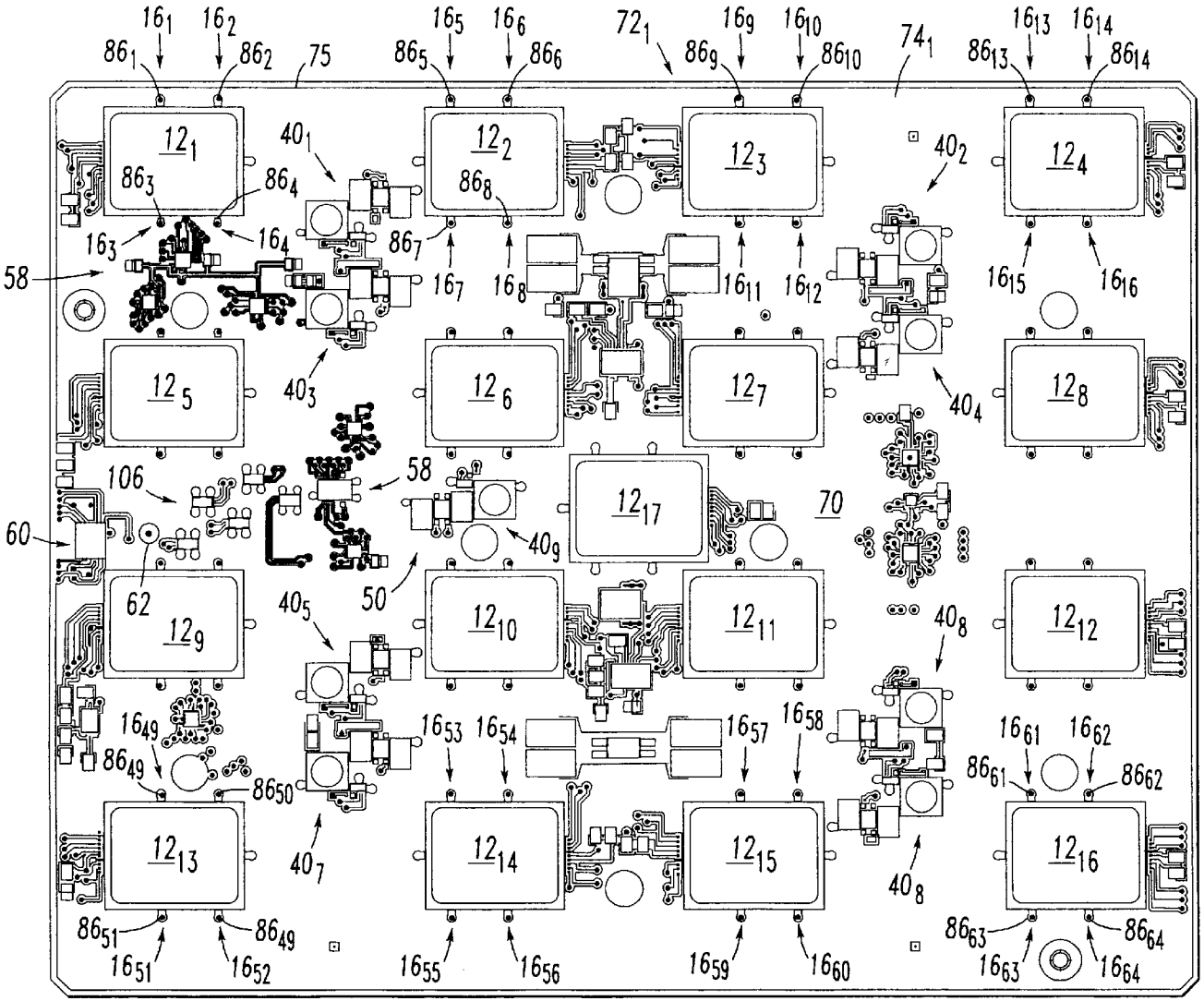
FIG. 5 is a top plan view illustrative of the physical layout of components located on the top of an antenna tile shown in FIG. 4.
Figure 6:
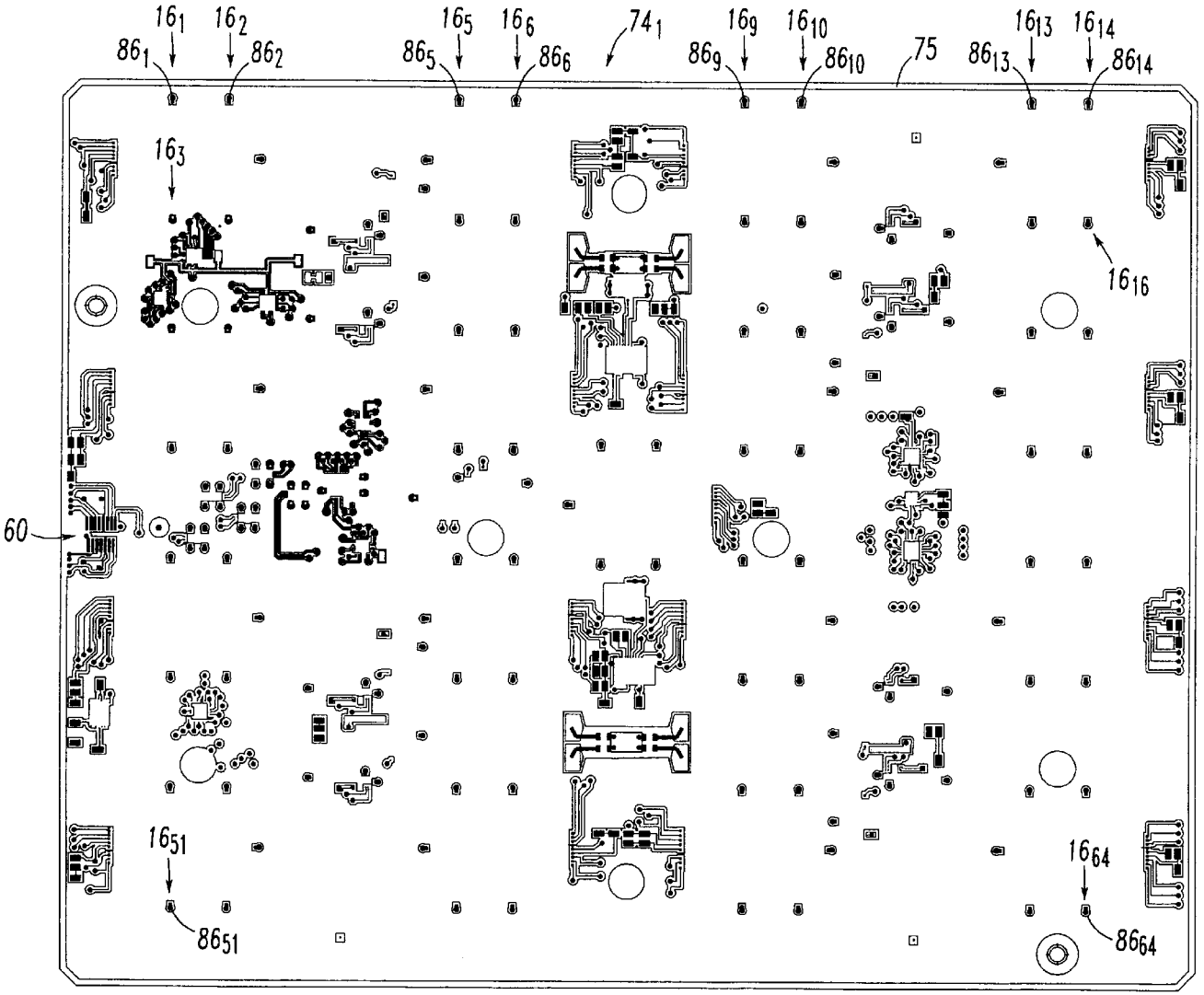
FIG. 6 is a top plan view of the metallization layer formed on a first surface of the antenna tile shown in FIG. 4.

Referring now to FIG. 5, this figure discloses the top surface $\mathbf{74}_1$ of the dielectric layer $\mathbf{72}_1$. Located thereon are most of the components for implementing the circuit configuration shown in FIG. 1, including, for example, the Quad TDU packages $\mathbf{12}_1 \ldots \mathbf{12}_{17}$ along with other circuit elements which cannot be located within the tile assembly 10 (FIG. 4). In addition to the components mounted on the top of the tile 10, most of the surface $\mathbf{74}_1$ comprises a ground plane 75 as shown in FIG. 6. It is significant to also note that the top surface $\mathbf{74}_1$ also includes the upper ends of a set of metallized vertical vias $\mathbf{86}_1, \ldots \mathbf{86}_{64}$ which implement the inner conductors of tuned RF feed lines $\mathbf{16}_1 \ldots \mathbf{16}_{64}$ to and from the radiator elements $\mathbf{14}_1 \ldots \mathbf{14}_{64}$ comprised of the patch radiator elements $\mathbf{80}_1 \ldots \mathbf{80}_{64}$ and $\mathbf{82}_1 \ldots \mathbf{82}_{64}$ shown in FIGS. 14 and 15.

Figure 11:
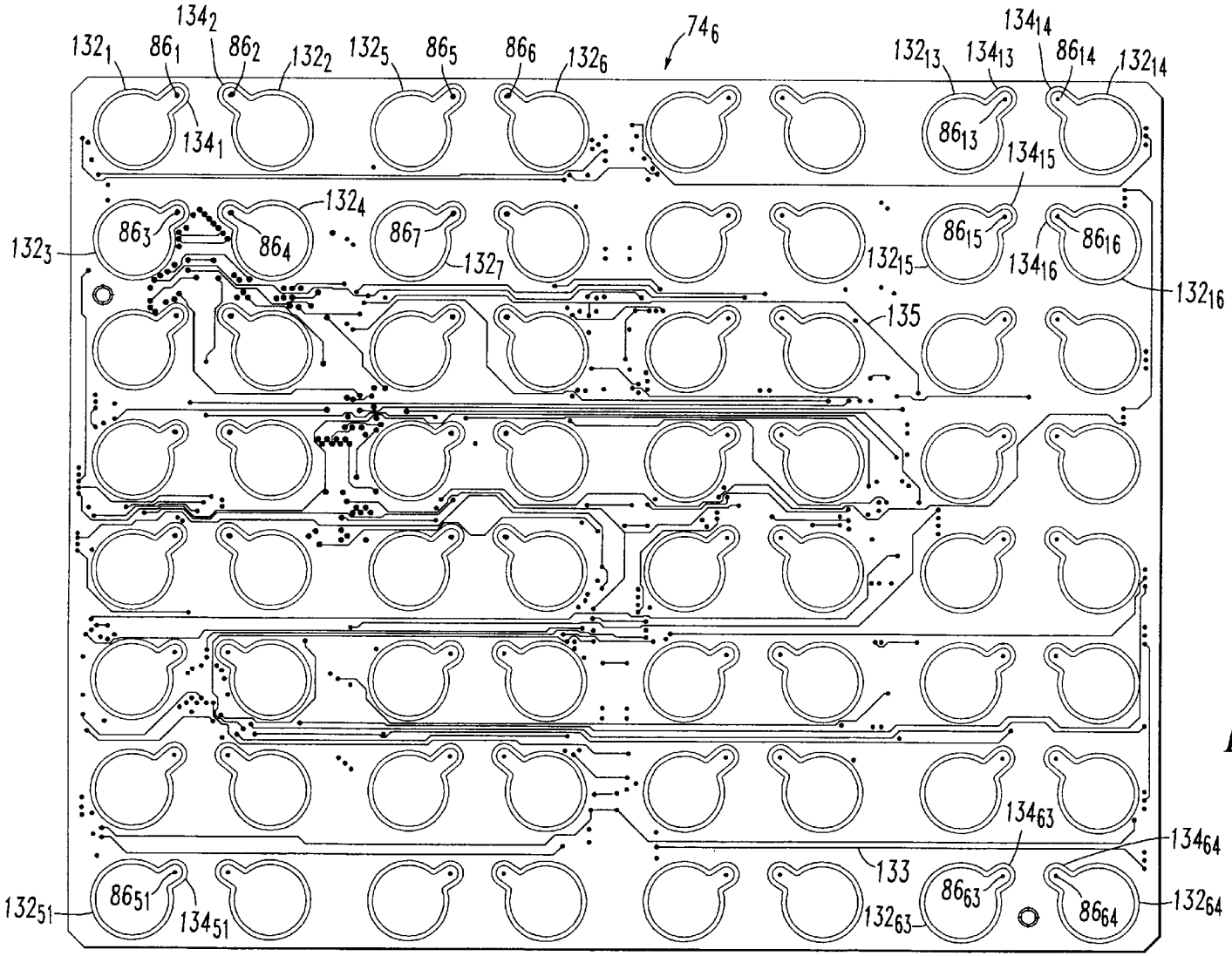
FIG. 11 is a top plan view of the printed circuit formed on a sixth surface of the antenna tile shown in FIG. 4.
Figure 12:
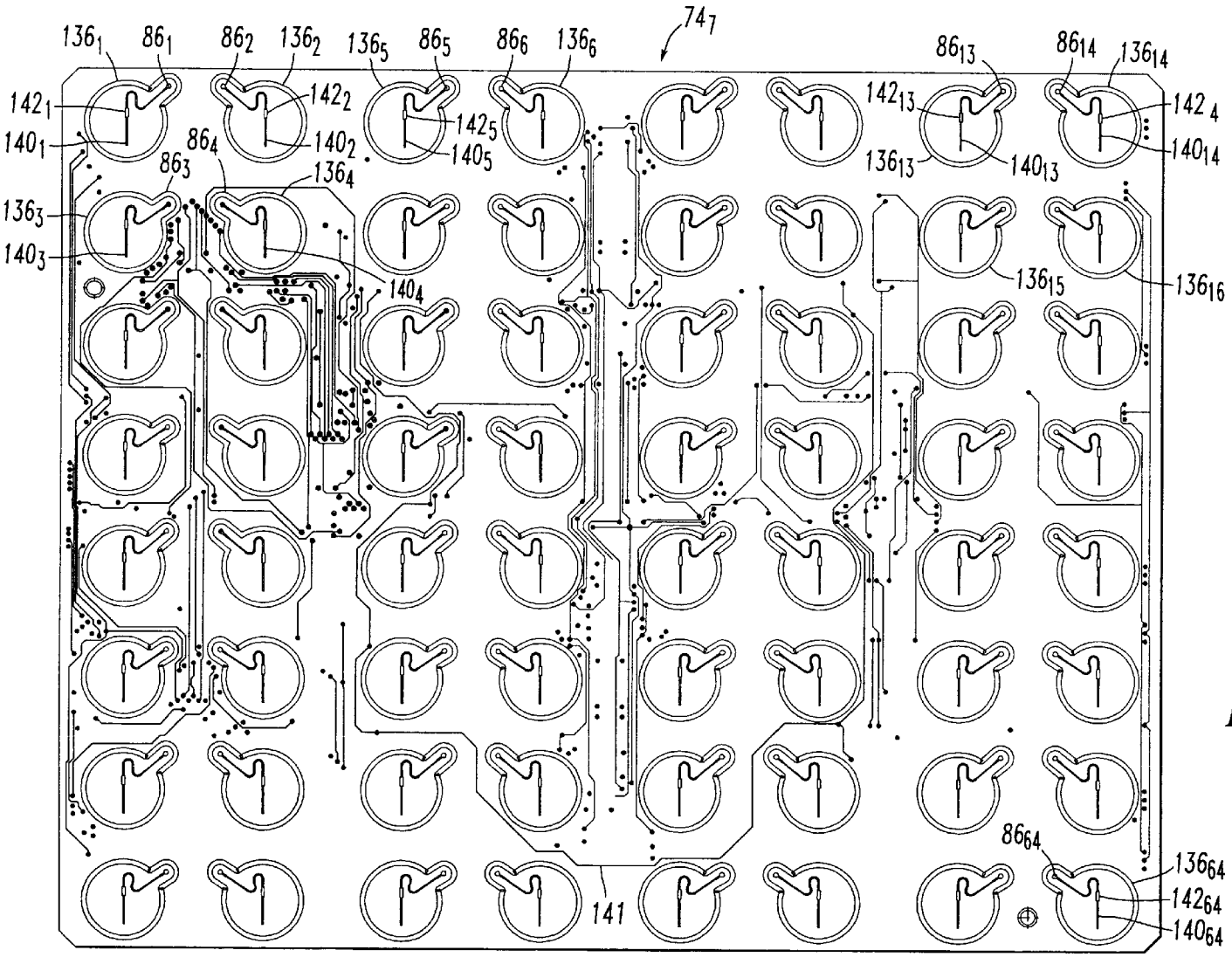
FIG. 12 is a top plan view of the printed circuit formed on a seventh surface of the antenna tile shown in FIG. 4.
Figure 13:
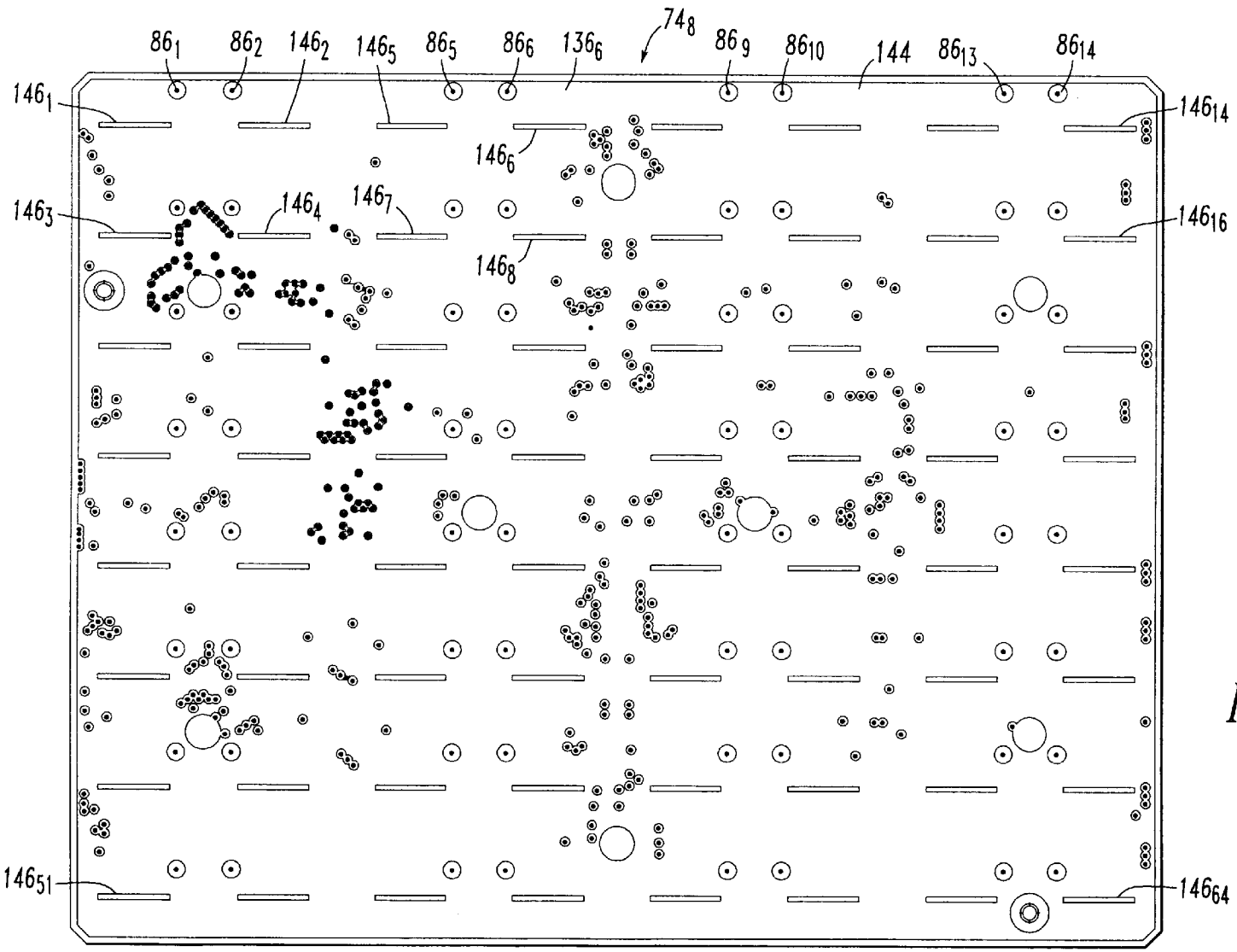
FIG. 13 is a top plan view of the metallization layer formed on an eighth surface of the antenna tile shown in FIG. 4.

The inner conductors $\mathbf{86}_1, \mathbf{86}_2 \ldots \mathbf{86}_{63}, \mathbf{86}_{64}$ of the feed lines $\mathbf{16}_1 \ldots \mathbf{16}_{64}$ are further shown in FIGS. 7 through 12, terminating in FIG. 13. The outer conductors $\mathbf{84}_1, \mathbf{84}_2, \ldots \mathbf{84}_{63}, \mathbf{84}_{64}$ of the coaxial RF feed lines are shown, for example, by respective rings of vias which encircle the inner conductor vias $\mathbf{86}_1 \ldots \mathbf{86}_{64}$. The rings of encircling vias $\mathbf{84}_1 \ldots \mathbf{84}_{64}$ also connect to annular of metallization members $\mathbf{87}_1 \ldots \mathbf{87}_{64}$ in metallization pattern $\mathbf{74}_4$ of FIG. 9, as well as through the patterns of metallization $\mathbf{74}_5$, $\mathbf{74}_6$, $\mathbf{74}_7$, $\mathbf{74}_8$ shown in FIGS. 10–13.

Figure 7:
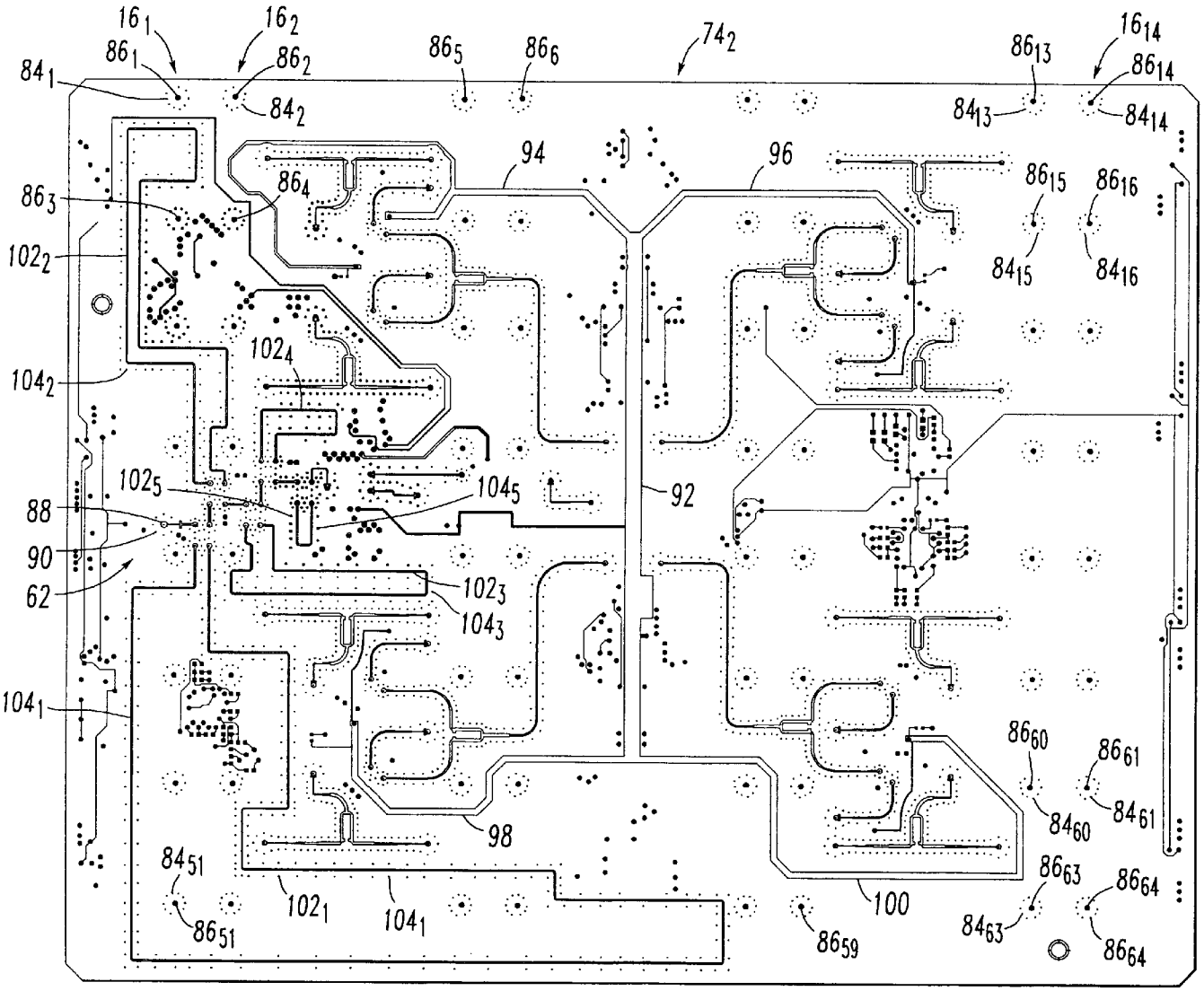
FIG. 7 is a top plan view of the printed circuit formed on a second surface of the antenna tile shown in FIG. 4.

Additionally shown in FIG. 7 is a relatively wide section of stripline 92 and four outwardly extending arms, 94, 96, 98 and 100, which act as DC power lines for the components used in RF transmission portion of the tile structure 70. The RF input/output connector 62 (FIG. 4) connects to an inner conductor 88 and a circular set of vias 90 of a coaxial feed line on the left side of the surface of metallization 742 shown in FIG. 7. This feed line 91 connects to the elements of the "long" variable time delay line (LTDU) shown by reference numeral 58 of FIG. 1 for imparting a common time delay to the RF signals in and out of antenna tile 70.

Figure 8:
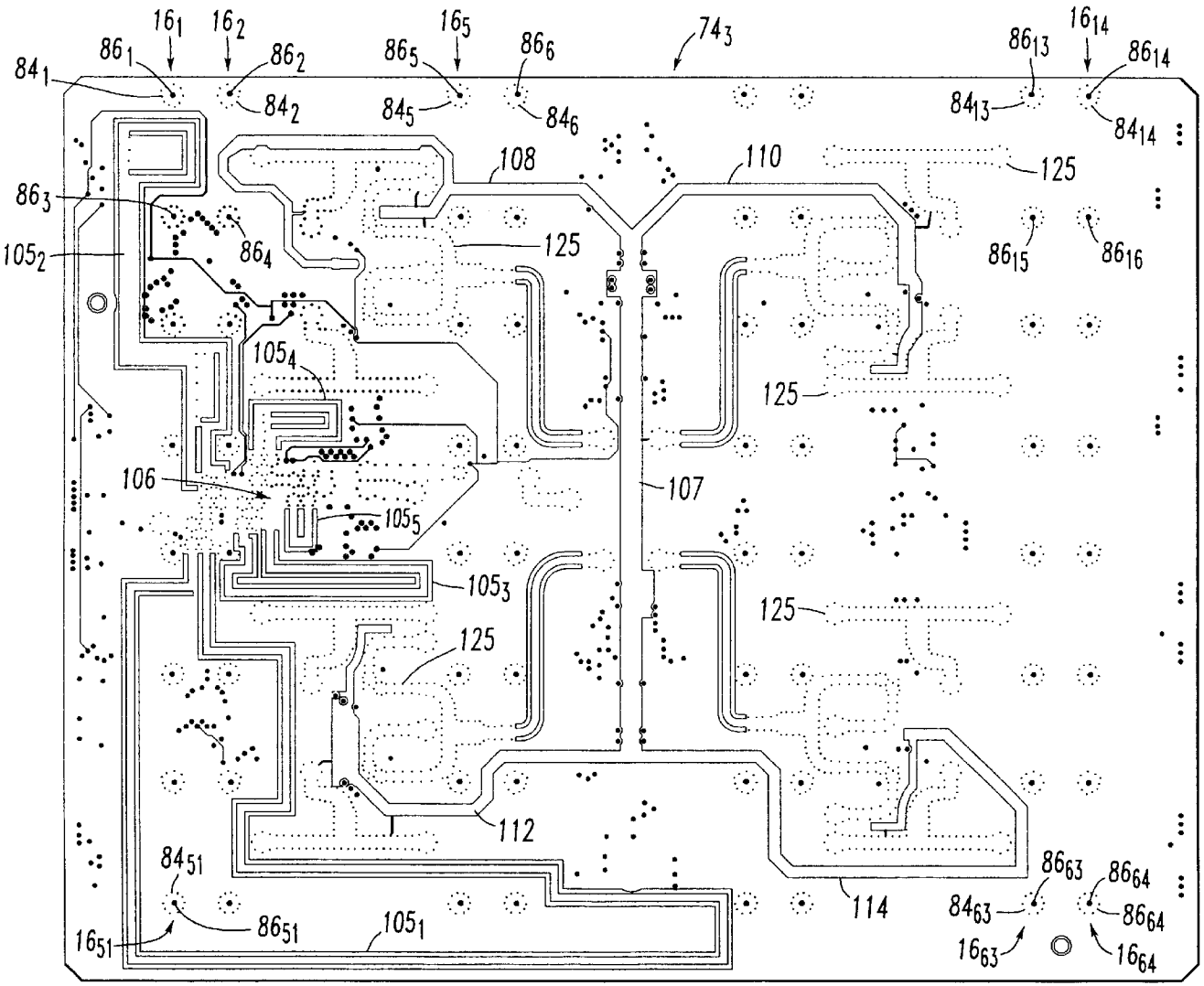
FIG. 8 is a top plan view of the printed circuit formed on a third surface of the antenna tile shown in FIG. 4.

The LTDU 68 consists of five discrete stripline line segments $\mathbf{102}_1$, $\mathbf{102}_2$, $\mathbf{102}_3$, $\mathbf{102}_4$ and $\mathbf{102}_5$ of varying length formed on the left hand side of the lower surface $\mathbf{74}_2$ of the dielectric layer $\mathbf{72}_2$ as shown in FIG. 7. The delay line segments of stripline $\mathbf{102}_1 \ldots \mathbf{102}_5$ also are surrounded by adjacent walls or fences $\mathbf{104}_1$, $\mathbf{104}_2$, $\mathbf{104}_3$, $\mathbf{104}_4$, and $\mathbf{104}_5$ of ground vias which connect to respective continuous fence elements $\mathbf{105}_1$, $\mathbf{105}_2$, $\mathbf{105}_3$, $\mathbf{105}_4$ and $\mathbf{105}_5$ as shown in FIG. 8 to achieve required isolation. The five delay line segments $\mathbf{102}_1 \ldots \mathbf{102}_5$ are, moreover, connected to a set of switch elements 106 shown in FIG. 5 located on the top surface $\mathbf{74}_1$, of the tile.

FIG. 8 shows the third pattern of metallization $\mathbf{74}_3$ (FIG. 4). In addition to the fence elements $\mathbf{105}_1 \ldots \mathbf{105}_5$ for the five delay line segments $\mathbf{102}_1, \ldots \mathbf{102}_5$ shown in FIG. 7, there is also shown a central elongated strip of metallization 107 and four outwardly extending arm segments 108, 110, 112 and 114 which acts as shielding between the upper DC power line segments 92, 94, 96, 98 and 100 of FIG. 7 and a set of underlying power line segments 116, 118, 120, 122, and 124 on the next lower surface $\mathbf{74}_4$ (FIG. 9), which are utilized for providing DC power for the receiver portion of the antenna tile structure 70.

FIG. 8 also shows a plurality of wall or fence vias 125 which are utilized as RF shielding for the various overlying stripline elements shown in FIG. 7 consisting of the power splitters shown in FIG. 1.

Figure 9:
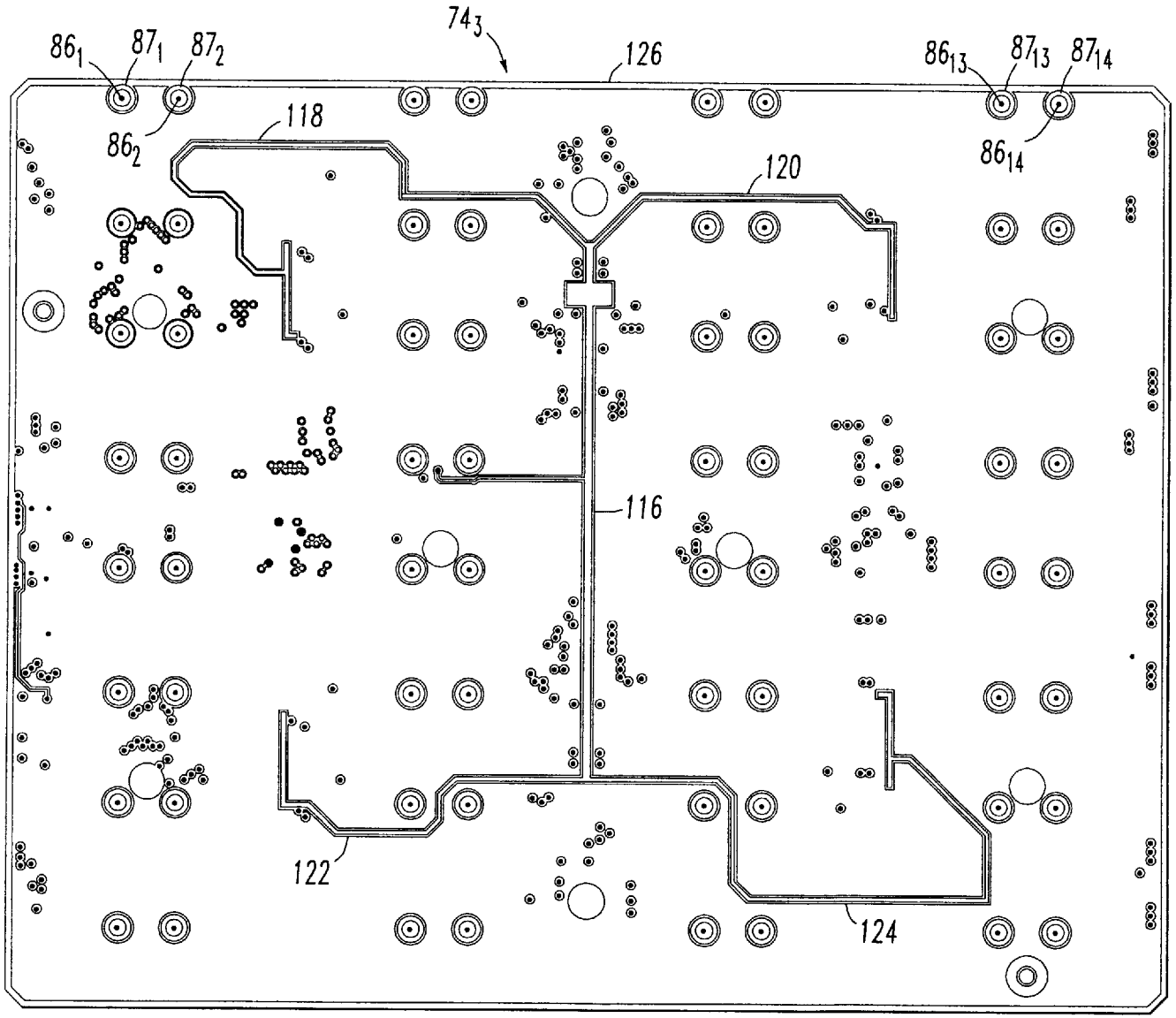
FIG. 9 is a top plan view of the metallization layer formed on a fourth surface of the antenna tile shown in FIG. 4.

With respect to FIG. 9, the surface $\mathbf{74}_4$ primarily comprises a ground plane 126; however, the sixty-four annular segments of stripline metallization $\mathbf{87}_1 \ldots \mathbf{87}_{64}$ which contact the upper sets of ring vias $\mathbf{84}_1, \ldots \mathbf{84}_{64}$ shown in FIGS. 7 and 8, are also located there at as noted above.

Figure 10:
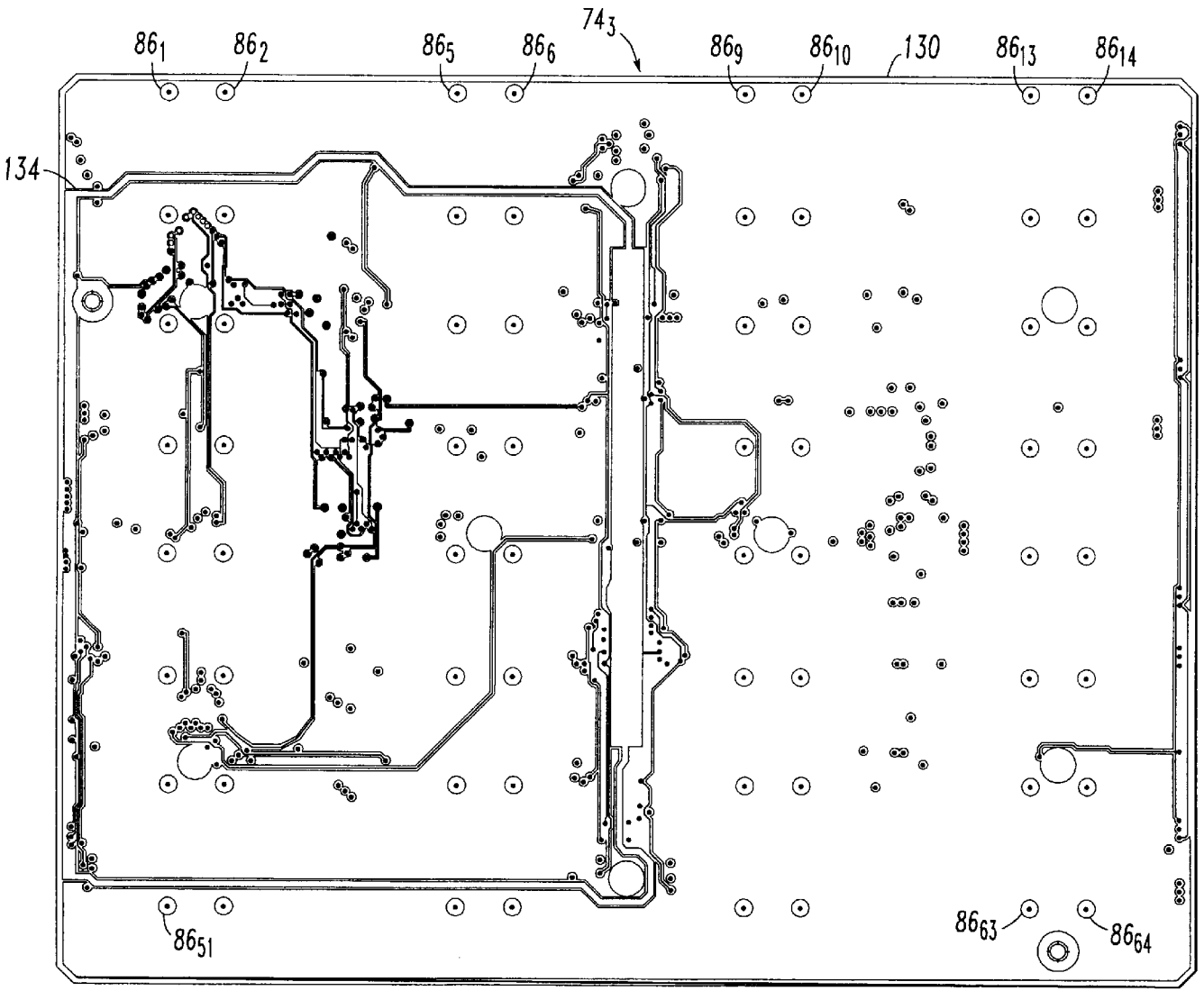
FIG. 10 is a top plan view of the metallization layer formed on a fifth surface of the antenna tile shown in FIG. 4.

Referring now to FIG. 10, shown there at is the metallization surface $\mathbf{74}_5$ (FIG. 4). It also acts primarily as a ground plane 130; however, it includes narrow lengths of stripline 131 for distributing DC power to the upper layers of the tile structure 70.

Continuing down through the remaining layers of metallization $\mathbf{74}_6$, $\mathbf{76}_7$ and $\mathbf{74}_8$ shown in FIG. 4 and further illustrated in FIGS. 11, 12 and 13, reference is now made to FIG. 11 wherein there is shown the pattern of metallization $\mathbf{74}_6$ located on the underside of dielectric layer $\mathbf{72}_5$ and consisting primarily of sixty-four RF signal isolation rings of metallization $\mathbf{132}_1, \mathbf{132}_2, \ldots \mathbf{132}_{64}$, including outwardly projecting portions $\mathbf{134}_1, \ldots \mathbf{134}_{64}$ thereof through which passes the inner conductor vias $\mathbf{86}_1, \ldots \mathbf{86}_{64}$ of the RF feed lines $\mathbf{16}_1 \ldots \mathbf{16}_{64}$ (FIG. 1). Also shown are various stripline elements 133 and 135, which are used to route the control signals and low current bias signals to the components on the surface of the tile.

The isolation rings $\mathbf{132}_1, \ldots \mathbf{132}_{64}$ are in registration with an underlying set of like isolation rings $\mathbf{136}_1, \ldots \mathbf{136}_{64}$ and projections $\mathbf{138}_1, \ldots \mathbf{138}_{64}$ as shown in FIG. 12, comprising a portion of the metallization surface $\mathbf{74}_7$ (FIG. 4). The isolation ring elements 132 (FIG. 11) and 136 (FIG. 12) act as resonant cavities for respective RF exciter elements $\mathbf{140}_1, \ldots \mathbf{140}_{64}$ shown in FIG. 12, including low impedance radiator tuning elements $\mathbf{142}_1, \ldots \mathbf{142}_{64}$ and which are connected to the RF inner conductor vias $\mathbf{86}_1, \ldots \mathbf{86}_{64}$ passing down through the contiguous layers $\mathbf{72}_1, \ldots \mathbf{72}_7$ shown in FIG. 4. Various DC conductor lines of stripline 141 are also shown in FIG. 12.

Referring now to FIG. 13, shown there at is the layer of metallization $\mathbf{74}_8$ (FIG. 4) which, primarily acts as a ground plane 144 However, sixty-four radiation slots $\mathbf{146}_1$, $\mathbf{146}_2, \ldots \mathbf{146}_{64}$ which transversely underlie the exciter elements $\mathbf{140}_1, \ldots \mathbf{140}_{64}$ (FIG. 12) are located in the metallization. The radiating slots $\mathbf{146}_1, \ldots \mathbf{146}_{64}$ operate to couple and receive energy from the space fed arrays of mutually aligned rectangular patch radiators $\mathbf{80}_1, \ldots \mathbf{80}_{64}$, $\mathbf{82}_1, \ldots \mathbf{82}_{64}$ formed on the outer surfaces of the foam layers $\mathbf{76}_1$ and $\mathbf{76}_2$ as shown in FIGS. 14 and 15 and which implement the radiators $\mathbf{14}_1 \ldots \mathbf{14}_{64}$ shown in FIG. 1. FIG. 13 also shows the RF feed line inner conductor vias $\mathbf{86}_1$, $\mathbf{86}_2, \ldots \mathbf{86}_{64}$ extending to and terminating in the ground plane surface 144 of the metallization $\mathbf{74}_8$. This portion of the vias $\mathbf{86}_1 \ldots \mathbf{86}_{64}$ acts as RF feed line tuning stubs, minimizing RF reflections from the radiator elements $\mathbf{80}_1 \ldots \mathbf{80}_{64}$ and $\mathbf{82}_1 \ldots \mathbf{82}_{64}$ of FIGS. 14 and 15.

Figure 16:
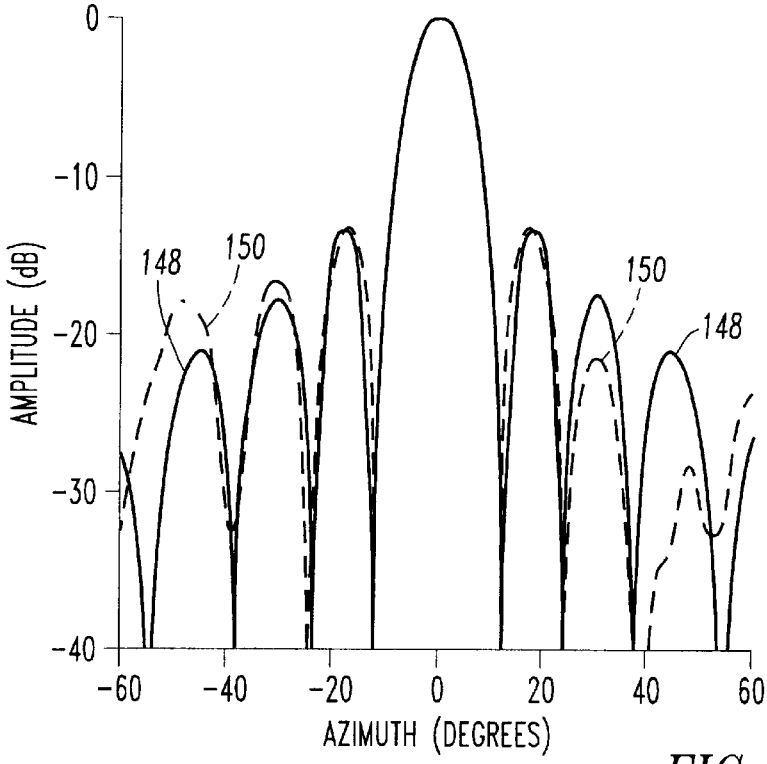
FIG. 16 is a receive far-field azimuth antenna pattern for the antenna tile shown in FIGS. 5–15.
Figure 17:
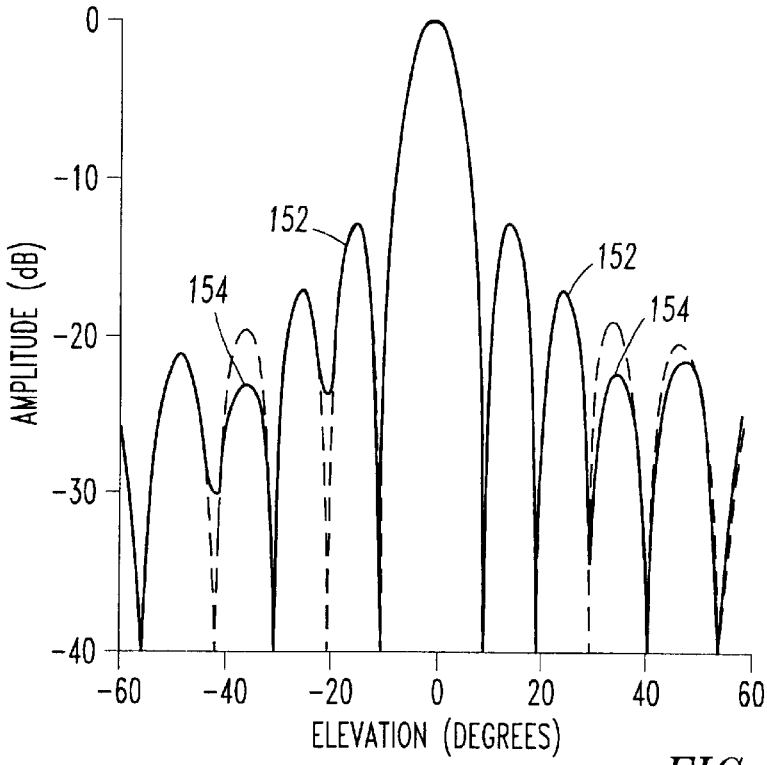
FIG. 17 is a receive far-field field elevation pattern for the antenna tile shown in FIGS. 5–15.
Figure 18:
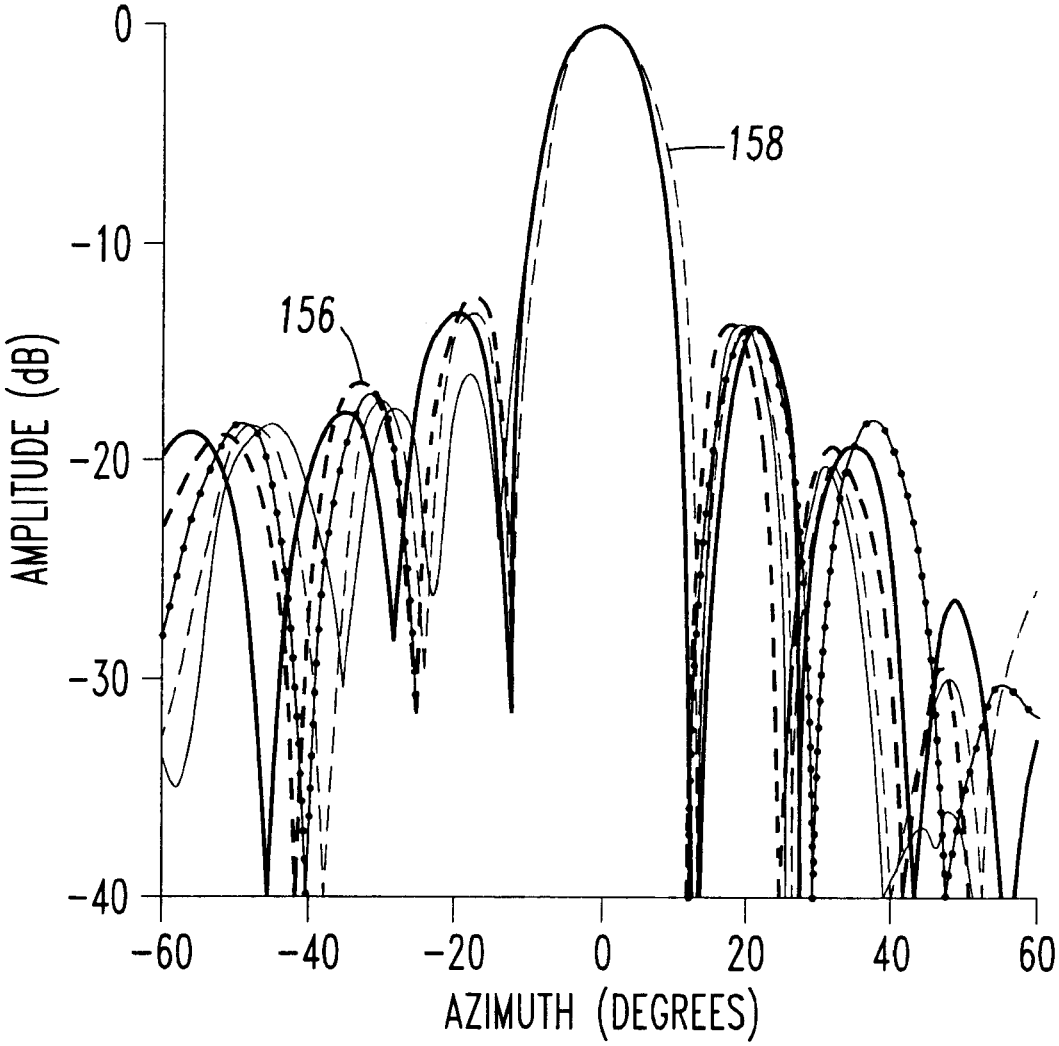
FIG. 18 is a set of transmit far-field azimuth patterns over the entire frequency band of the antenna tile shown in FIGS. 5–15.

FIGS. 16–18 are illustrative of far-field radiation patterns obtained from an antenna tile 70 fabricated in accordance with the drawing figures shown in FIGS. 5–15. FIG. 16, for example, shows a set of theoretical receive far-field azimuth patterns 148 and a set of measured patterns 150 at broadside while FIG. 17 discloses a set of theoretical receive far-field elevation patterns 152 and a set of measured patterns 154 at broadside. FIG. 18 is illustrative of a set of transmit far-field azimuth patterns 156 over the entire frequency band for which the tile is designed and shows that the main beam 158 remains fixed in location as frequency is varied due to the use of true time delay rather than phase shift.

A fabrication of tile antenna in accordance with the subject invention uses standard printed circuit board techniques and materials. All vias are through drills (as opposed to blind laser drilled vias) which greatly simplifies substrate manufacturing. The RF manifolds are fabricated as unbalanced stripline. The symmetric and binary nature of the tile allows for the use of a corporate manifold which uses equal split Wilkinson power dividers and is very forgiving of manufacturing errors, since all the power divisions are of equal magnitude. Layer sharing is necessary to minimize the tile substrate mass; however, it does force special care to maintain a high level of isolation between the RF and DC circuits. All RF traces are surrounded by walls of ground vias, which are tied together on multiple layers to achieve the required isolation. The logic manifold is located primarily between the radiator feed cavities. Also, special care is required to isolate the clock lines from the RF circuitry. The tile, when fabricated with only through drilled holes, achieves a high tile yield, but this means that all vias that connect to the digital circuits must have shielded stubs that extend to the lowermost ground plane layer.

The foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed:

1. A phased array antenna of an active electronically scanned antenna system, comprising:

one or more antenna tile structures, each of said antenna tile structures further comprising, a laminated assembly including a plurality of contiguous layers of dielectric material having patterns of metallization formed on one or more surfaces thereof and selectively interconnected by an arrangement of surface conductors and conductive vias for implementing transmission, reception, and control of RF signals between an RF input/output terminal and a plurality of radiator elements of an antenna assembly; and wherein said radiator elements comprise elements of a space-fed patch antenna assembly including first and second mutually adjacent arrays of aligned patch radiators located on respective layers of foam material on one side of the antenna tile structure.

2. A phased array antenna according to claim 1 and further comprising, a plurality of MEMS type switched time delay units (TDUs) coupled between said radiator elements and a signal circulator comprising one circuit element of a plurality of intermediate transmit/receive (TR) circuits each including a transmit RF signal amplifier, a receive RF signal amplifier and a TR switch, each of said TDUs including like sets of delay transmission lines having a plurality of different time delay portions selectively connected by a plurality of microelectromechanical switch (MEMS) devices to a respective radiator element of said antenna assembly.

3. A phased array antenna according to claim 2 wherein sets of four TDUs of said plurality of TDUs are packaged in a plurality of Quad time delay units (Quad TDUs).

4. A phased array antenna according to claim 3 wherein each Quad TDU further includes a set of signal splitters connected to the four TDUs packaged therein.

5. A phased array antenna according to claim 4 wherein said plurality of Quad TDUs are mounted on said other side of the antenna tile structure.

6. A phased array antenna according to claim 5 and further comprising another said Quad TDU coupled, via respective signal splitters, between said plurality of intermediate TR circuits and a signal circulator comprising one element of a common TR circuit, said common TR circuit also including a transmit RF signal amplifier, a receive RF signal amplifier and a TR switch.

7. A phased array antenna according to claim 5 and further comprising a second common TR circuit connected in tandem to said intermediate TR circuits via a signal splitter circuit, said common TR circuit including another transmit RF amplifier and another receive RF amplifier switched between a variable RF signal attenuator.

8. A phased array antenna according to claim 7 and further comprising an RF signal time delay unit coupled between said variable RF signal attenuator and said RF signal input/output terminal for providing a common time delay for all RF signals propagating between said radiator elements and said input/output terminal.

9. A phased array antenna according to claim 8 wherein said RF signal time delay unit comprises a variable time delay unit providing a larger time delay than that provided by the time delay portions of said TDUs and comprising a plurality of discrete transmission line elements of selectively varying lengths of RF transmission line.

10. A phased array antenna according to claim 9 wherein the transmission line elements of said RF signal time delay unit are fabricated on a surface of one of said layers of dielectric material.

11. A phased array antenna according to claim 10 wherein said transmission line elements of said RF signal time delay unit comprise lengths of stripline and being isolated from other circuit elements by adjacent lines of vias on both sides thereof.

12. A phased array antenna according to claim 2 wherein said radiator elements are respectively coupled to said TDUs by RF transmission line elements passing through said layers of dielectric material and including a configuration of conductor vias including an inner via of conductor material and a set of ring type vias forming a coaxial transmission line, and additionally including exciter elements connected to said inner vias and being located in respective resonant cavities formed of stripline metallization on at least one of said layers of dielectric material, and respective radiation slots located adjacent said exciter elements formed in a pattern of stripline metallization on a lowermost layer of said plurality of layers of dielectric material adjacent the patch radiators.

13. A phased array antenna according to claim 12 wherein said resonant cavities comprise annular members of stripline material respectively surrounding the exciter elements.

14. A phased array antenna according to claim 12 wherein said inner vias terminate in tuning stub elements at said lowermost layer.

15. A phased array antenna of an active electronically scanned antenna system, comprising:

one or more antenna tile structures, each of said antenna tile structures further comprising, a laminated assembly including a plurality of contiguous layers of dielectric material having patterns of metallization formed on one or more surfaces thereof and selectively interconnected by an arrangement of surface conductors and conductive vias for implementing transmission, reception, and control of RF signals between an RF input/output terminal and a plurality of radiator elements of an antenna assembly;

wherein said radiator elements comprise elements of a space-fed patch antenna assembly including first and second mutually adjacent arrays of aligned patch radiators located on one side of the antenna tile structure;

a plurality of switched time delay units (TDUs) coupled between said radiator elements and a signal circulator comprising one circuit element of a plurality of intermediate transmit/receive (TR) circuits each including a transmit RF signal amplifier, a receive RF signal amplifier and a TR switch, each of said TDUs including like sets of delay transmission lines having a plurality of different time delay portions selectively connected by a plurality of switch devices to a respective radiator element of said antenna assembly; and wherein sets of four TDUs of said plurality of TDUs are packaged in a plurality of Quad time delay units (Quad TDUs).

16. A phased array antenna of an active electronically scanned antenna system, comprising:

one or more antenna tile structures, each of said antenna tile structures further comprising, a laminated assembly including a plurality of contiguous layers of dielectric material having patterns of metallization formed on one or more surfaces thereof and selectively interconnected by an arrangement of surface conductors and conductive vias for implementing transmission, reception, and control of RF signals between an RF input/output terminal and a plurality of radiator elements of an antenna assembly; and wherein said radiator elements comprise elements of a space-fed patch antenna assembly including first and second mutually adjacent arrays of aligned patch radiators located on respective layers of support material on one side of the antenna tile structure; and a plurality of switched time delay units (TDUs) coupled between said radiator elements and a signal circulator comprising one circuit element of a plurality of intermediate transmit/receive (TR) circuits each including a transmit RF signal amplifier, a receive RF signal amplifier and a TR switch, each of said TDUs including like sets of delay transmission lines having a plurality of different time delay portions selectively connected by a plurality of switch devices to a respective radiator element of said antenna assembly;

further comprising a common TR circuit connected in series to said intermediate TR circuits via a signal splitter circuit, said common TR circuit including another transmit RF amplifier, another receive RF amplifier switched between a variable RF signal attenuator and an RF signal time delay unit coupled between said variable RF signal attenuator and said RF signal input/output terminal for providing a common time delay for all RF signals propagating between said radiator elements and said input/output terminal.

17. A phased array antenna according to claim 16 wherein said TDUs are comprised of MEMS type switched time delay units and said switch devices are comprised of microelectromechanical switch (MEMS) devices.

18. A phased array antenna according to claim 16 wherein said RF signal time delay unit comprises a variable time delay unit providing a larger time delay than that provided by the time delay portions of said TDUs and comprising a plurality of discrete transmission line elements of selectively varying lengths of RF transmission line.

19. A phased array antenna of an active electronically scanned antenna system, comprising:

one or more antenna tile structures, each of said antenna tile structures further comprising, a laminated assembly including a plurality of contiguous layers of dielectric material having patterns of metallization formed on one or more surfaces thereof and selectively interconnected by an arrangement of surface conductors and conductive vias for implementing transmission, reception, and control of RF signals between an RF input/output terminal and a plurality of radiator elements of an antenna assembly;

wherein said radiator elements comprise elements of a space-fed patch antenna assembly including first and second mutually adjacent arrays of aligned patch radiators located in spaced apart relationship on one side of the antenna tile structure;

a plurality of switched time delay units (TDUs) coupled between said radiator elements and a signal circulator comprising one circuit element of a plurality of intermediate transmit/receive (TR) circuits each including a transmit RF signal amplifier, a receive RF signal amplifier and a TR switch, each of said TDUs including like sets of delay transmission lines having a plurality of different time delay portions selectively connected by a plurality of switch devices to a respective radiator element of said antenna assembly;

wherein said radiator elements are respectively coupled to said TDUs by RF transmission line elements passing through said layers of dielectric material and including a configuration of conductor vias including an inner via of conductor material and a set of ring type vias forming a coaxial transmission line, and additionally including exciter elements connected to said inner vias and being located in respective resonant cavities formed of stripline metallization on at least one of said layers of dielectric material, and respective radiation slots located adjacent said exciter elements formed in a pattern of stripline metallization on a lowermost layer of said plurality of layers of dielectric material adjacent the patch radiators.

20. A phased array antenna according to claim 19 wherein said resonant cavities comprise annular members of stripline material respectively surrounding the exciter elements.

21. A phased array antenna according to claim 19 wherein said inner vias terminate in tuning stub elements at said lowermost layer.

22. A phased array antenna according to claim 19 wherein said TDUs comprise MEMS type switched time delay units.

23. A phased array antenna according to claim 19 wherein said switch devices comprise microelectromechanical switch (MEMS) devices.

24. A phased array antenna according to claim 19 wherein said radiation elements are comprised of generally rectangular patch radiator elements.

* * * * *